US007909115B2

(12) United States Patent
Grove et al.

(10) Patent No.: US 7,909,115 B2
(45) Date of Patent: Mar. 22, 2011

(54) METHOD FOR PERFORATING UTILIZING A SHAPED CHARGE IN ACIDIZING OPERATIONS

(75) Inventors: Brenden Grove, Missouri City, TX (US); Ian Walton, Frisco, TX (US); Lawrence A. Behrmann, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 160 days.

(21) Appl. No.: 11/851,891

(22) Filed: Sep. 7, 2007

(65) Prior Publication Data

US 2009/0114382 A1 May 7, 2009

(51) Int. Cl.

| | |
|---|---|
| ***E21B 43/116*** | (2006.01) |
| ***E21B 43/263*** | (2006.01) |
| ***E21B 29/00*** | (2006.01) |
| ***F42D 3/02*** | (2006.01) |

(52) U.S. Cl. ..... 175/4.6; 175/4.55; 166/297; 166/55

(58) Field of Classification Search ..... 166/297, 166/299, 55; 175/4.6, 4.55

See application file for complete search history.

(56) References Cited

U.S. PATENT DOCUMENTS

| | | | | |
|---|---|---|---|---|
| 2,080,875 | A * | 5/1937 | Pitzer | 166/299 |
| 2,766,828 | A * | 10/1956 | Rachford, Jr. | 166/299 |
| 3,054,938 | A * | 9/1962 | Meddick | 102/310 |
| 3,269,467 | A | 8/1966 | Bell | |
| 3,674,091 | A | 7/1972 | Kisling, III | |
| 4,160,412 | A * | 7/1979 | Snyer et al. | 102/307 |
| 4,253,523 | A * | 3/1981 | Ibsen | 166/299 |
| 5,413,048 | A | 5/1995 | Werner et al. | |
| 5,421,418 | A * | 6/1995 | Nelson et al. | 175/2 |
| 6,296,044 | B1 | 10/2001 | Brooks et al. | |
| 6,460,463 | B1 | 10/2002 | Parrott et al. | |
| 6,464,019 | B1 | 10/2002 | Werner et al. | |
| 6,817,415 | B2 | 11/2004 | Orban et al. | |
| 6,896,059 | B2 | 5/2005 | Brooks et al. | |
| 6,989,064 | B2 | 1/2006 | Kneisl | |
| 7,287,589 | B2 * | 10/2007 | Grove et al. | 166/297 |
| 7,428,921 | B2 * | 9/2008 | Grove et al. | 166/55.1 |
| 7,581,498 | B2 * | 9/2009 | Hetz et al. | 102/306 |
| 2006/0000607 | A1 | 1/2006 | Surjaatmadja et al. | |
| 2007/0114022 | A1 * | 5/2007 | Nguyen | 166/250.1 |
| 2008/0282924 | A1 * | 11/2008 | Saenger et al. | 102/306 |
| 2009/0151949 | A1 * | 6/2009 | Marya et al. | 166/297 |

FOREIGN PATENT DOCUMENTS

| | | | |
|---|---|---|---|
| EP | 1757896 | A1 * | 2/2007 |
| GB | 2421966 | A | 7/2006 |

* cited by examiner

*Primary Examiner* — Kenneth Thompson
*Assistant Examiner* — Catherine Loikith
(74) *Attorney, Agent, or Firm* — Andrus, Sceales, Starke & Sawall, LLP; Kevin B. McGoff; Rodney V. Warfford

(57) ABSTRACT

A shaped charge includes: a charge case; an explosive disposed inside the charge case; and a liner for retaining the explosive in the charge case, wherein the liner is fabricated from a material soluble with a selected dissolving fluid (e.g., an acid, an acid matrix, an injection fluid, a completion fluid, and/or a wellbore fluid). A method for perforating in a well includes the steps of: disposing a perforating gun in the well, wherein the perforating gun comprises a shaped charge having a charge case, an explosive disposed inside the charge case, and a liner for retaining the explosive in the charge case, wherein the liner is fabricated from a material soluble with a selected dissolving fluid; detonating the shaped charge to form a perforation tunnel in a formation zone; and exposing the material comprising the liner to the selected dissolving fluid.

10 Claims, 9 Drawing Sheets

METHOD FOR PERFORATING UTILIZING A SHAPED CHARGE IN ACIDIZING OPERATIONS

BACKGROUND OF INVENTION

1. Field of the Invention

The present invention relates generally to perforating tools used in downhole applications, and more particularly to a shaped charge for use in generating a perforation tunnel in a target formation zone in a well, wherein the target formation zone will be acidized.

2. Background Art

To complete a well, one or more formation zones adjacent a wellbore are perforated to allow fluid from the formation zones to flow into the well for production to the surface or to allow injection fluids to be applied into the formation zones. A perforating gun string may be lowered into the well and one or more guns fired to create openings in casing and to extend perforations into the surrounding formation.

Various embodiments of the present invention are directed at perforating charges and methods of perforation for generating an improved perforating tunnel.

SUMMARY OF INVENTION

In one aspect, embodiments disclosed herein relate to shaped charges. A shaped charge in accordance with one embodiment of the invention includes a charge case; an explosive disposed inside the charge case; and a liner for retaining the explosive in the charge case, wherein the liner comprises a material soluble (or otherwise reactive) with a fluid, wherein the fluid is one of the following: an acid or acidizing matrix, a fracturing fluid, or a completions fluid.

In another aspect, embodiments of the invention relate to methods for perforating in a well. A method for perforating in a well in accordance with one embodiment of the invention includes: (1) disposing a perforating gun in the well, wherein the perforating gun comprises a shaped charge having a charge case, an explosive disposed inside the charge case, and a liner for retaining the explosive in the charge case, wherein the liner includes a material that is soluble (or otherwise reactive) with an acid or acidizing matrix, a fracturing fluid, or a completions fluid; (2) detonating the shaped charge to form a perforation tunnel in a formation zone and leaving charge liner residue within the perforating tunnel (on the well and tip); (3) performing one of the following: (i) pumping an acid or acidizing matrix downhole, (ii) pumping a fracturing fluid downhole, (iii) or circulating a completion or wellbore fluid downhole to contact the charge liner residue in the perforation tunnel; and (4) allowing the material comprising the liner to dissolve (or otherwise react) with the acid or acidizing matrix, a fracturing fluid, or a completions fluid.

In alternative embodiments, before the pumping operation, the perforating tunnel is surged (e.g., by creating an dynamic underbalanced in the well proximate the perforation tunnel) to remove the charge liner residue from the wall of the perforating tunnel. In these embodiments, the pumping operation is directed at removing the charge liner residue from the tip of the perforating tunnel.

Other aspects and advantages of the invention will become apparent from the following description and the attached claims.

DETAILED DESCRIPTION

Figure 1:
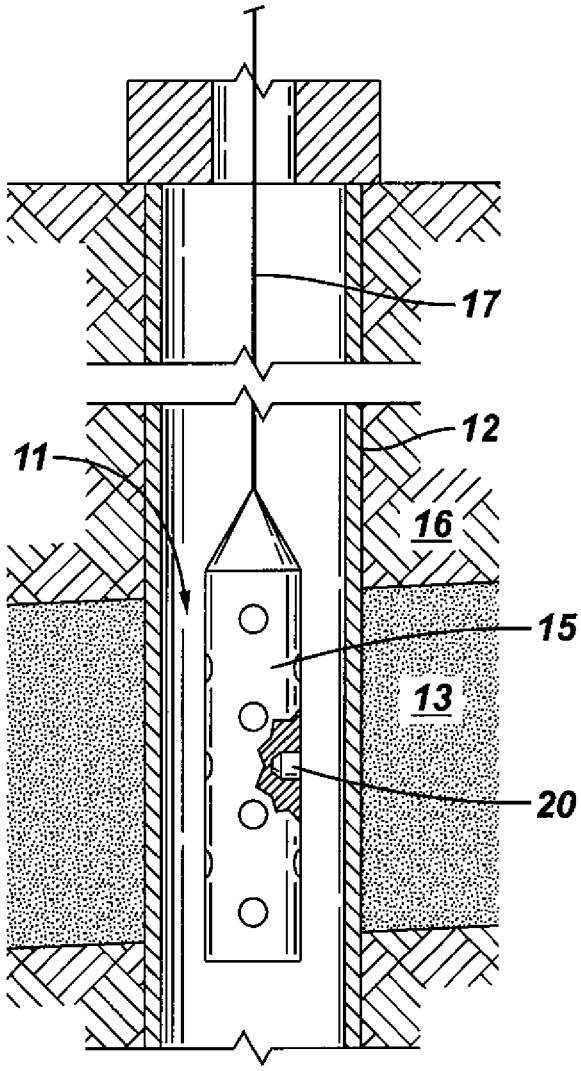
FIG. 1 shows a perforation operation, illustrating a perforation gun disposed in a well.

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and "downwardly", "upstream" and "downstream"; "above" and "below"; and other like terms indicating relative positions above or below a given point or element are used in this description to more clearly describe some embodiments of the invention. Furthermore, the term "treatment fluid" includes any fluid delivered to a formation to stimulate production including, but not limited to, fracing fluid, acid, gel, foam or other stimulating fluid. Moreover, various types of perforating guns exist. One type of perforating guns includes capsule charges that are mounted on a strip in various patterns. The capsule charges are protected from the harsh wellbore environment by individual containers or capsules. Another type of perforating guns includes non-capsule shaped charges, which are loaded into a sealed carrier for protection. Such perforating guns are sometimes referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. In a hollow-carrier gun, charges shoot through the carrier into the surrounding casing formation. While embodiments of the present invention are described with respect to shaped charges for use in carrier-type gun systems, it is intended that other embodiments of the present invention include capsule-type gun systems.

After perforating a formation interval of a well, it is sometimes necessary or desired to pump a fluid into well to contact the formation. One example of such a fluid is an acid used in well acidizing operations. Well acidizing is a term well-known to those skilled in the art of petroleum engineering and includes various techniques such as "acid washing", "acid fracturing", and "matrix acidizing". Acid washing involves the pumping of acid into the wellbore to remove near-well formation damage and other damaging substances. This procedure commonly enhances production by increasing the effective well radius. When performed at pressures above the pressure required to fracture the formation, the procedure is often referred to as acid fracturing. In acid fracturing operations, flowing acid tends to etch the fracture faces of the formation in a nonuniform pattern, thus forming conductive channels that remain open without a propping agent after the fracture closes. Finally, matrix acidizing involves the treatment of a reservoir formation with a stimulation fluid containing a reactive acid. For instance, in sandstone formations, the acid reacts with the soluble substances in the formation matrix to enlarge the pore spaces, and in carbonate formations, the acid dissolves the entire formation matrix. In each case, the matrix acidizing treatment improves the formation permeability to enable enhanced production of reservoir fluids. Matrix acidizing operations are ideally performed at high rate, but at treatment pressures below the fracture pressure of the formation. This enables the acid to penetrate the formation and extend the depth of treatment while avoiding damage to the reservoir formation. Examples of acids to be used include, but are not limited to: hydrochloric acid, hydrofluoric acid, acetic acid, and formic acid In another example, it may be necessary or desired to pump a fracturing fluid into the well in hydraulic fracturing operations. Fracturing is a well stimulation process that is employed to achieve improved production in a target formation. Generally, the target formation is under-performing due to restriction of natural flow. In a fracturing operation, the fracturing fluid is pumped into the well at sufficiently high pressure to actually fracture the target formation. Once fractured, a proppant (e.g., a sand or a ceramic material) is then added to the fluid and injected into the fracture to prop open such fractures. This permits hydrocarbons to flow more freely into the wellbore. Once the proppant has been set into the fracture, the fracturing fluid flows out of the formation and well leaving the proppant in place. This generates a highly conductive flow path between the well and formation. Examples of fracturing fluids to be used include, but are not limited to: water or acids (such as those described above).

In yet another example, it may be necessary or desirable to inject a fluid back into the reservoir at a selected formation interval for a variety of reasons. For instance, it may be an objective to inject into a fluid (e.g., seawater or separated gas) into a reservoir to maintain reservoir pressure. Examples of injection fluids include, but are not limited to: water or seawater.

In still another example, it may be necessary or desired to pump a completions fluid into the well. A completion fluid is a solids-free liquid used to "complete" an oil or gas well. This fluid is placed in the well to facilitate final operations prior to initiation of production, such as setting screens production liners, packers, downhole valves or shooting perforations into the producing zone. The fluid is meant to control a well should downhole hardware fail, without damaging the producing formation or completion components. Completion fluids are typically brines (chlorides, bromides and formates), but in theory could be any fluid of proper density and flow characteristics. The fluid should be chemically compatible with the reservoir formation and fluids, and is typically filtered to a high degree to avoid introducing solids to the near-wellbore area.

Generally, this invention relates to a shaped charge, a perforating system, and method for perforating in a wellbore, cased or open (i.e., uncased). A shaped charge in accordance with one embodiment of the invention includes a charge case; an explosive disposed inside the charge case; and a liner for retaining the explosive in the charge case, wherein the liner comprises a material soluble (or otherwise reactive) with a fluid, wherein the fluid is one of the following: an acid, a fracturing fluid, an injection fluid, or a completions fluid. Examples of soluble materials that may be used to form the charge liner include: powdered metals, such as iron, magnesium, zinc, and aluminum, and any alloy or combination thereof. Acids that may be used to dissolve any charge liner residue in acidizing operations include, but are not limited to: hydrochloric acid, hydrofluoric acid, acetic acid, and formic acid. Fracturing fluids that may be used to dissolve any charge liner residue in fracturing operations include, but are not limited to: acids, such as hydrochloric acid and hydrofluoric acid. Injection fluids that may be pumped into the formation interval to dissolve any charge liner residue include, but are not limited to: water and seawater. Completion fluids that may be circulated proximate the formation interval to dissolve any charge liner residue include, but are not limited to.

With reference to FIG. 1, after a well 11 is drilled, a casing 12 is typically run in the well 11 and cemented to the well 11 in order to maintain well integrity. After the casing 12 has been cemented in the well 11, one or more sections of the casing 12 that are adjacent to the formation zones of interest (e.g., target well zone 13) may be perforated to allow fluid from the formation zones to flow into the well for production to the surface or to allow injection fluids to be applied into the formation zones. To perforate a casing section, a perforating gun string may be lowered into the well 11 to a desired depth (e.g., at target zone 13), and one or more perforation guns 15 are fired to create openings in the casing and to extend perforations into the surrounding formation 16. Production fluids in the perforated formation can then flow through the perforations and the casing openings into the wellbore.

Typically, perforating guns 15 (which include gun carriers and shaped charges mounted on or in the gun carriers or alternatively include sealed capsule charges) are lowered through tubing or other pipes to the desired formation interval on a line 17 (e.g., wireline, e-line, slickline, coiled tubing, and so forth). The charges carried in a perforating gun may be phased to fire in multiple directions around the circumference of the wellbore. Alternatively, the charges may be aligned in a straight line. When fired, the charges create perforating jets that form holes in surrounding casing as well as extend perforation tunnels into the surrounding formation.

Figure 2:
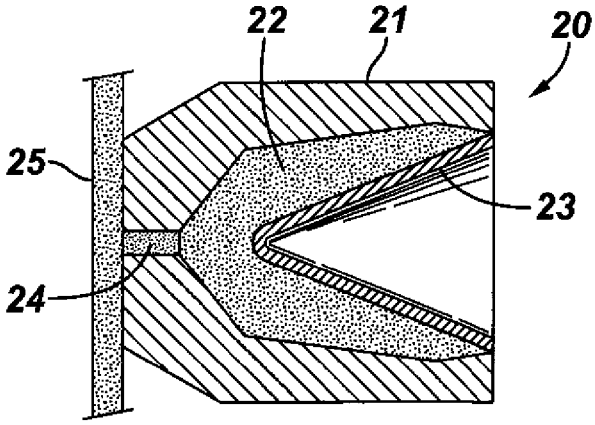
FIG. 2 shows a shaped charge for use in a perforation operation in accordance with embodiments of the present invention.

Referring to FIG. 2, a shaped charge 20 in accordance with embodiments of the present invention includes an outer case (a charge case) 21 that acts as a containment vessel designed to hold the detonation force of the detonating explosion long enough for a perforating jet to form. Materials for making the charge case may include steel or other sturdy metals. The main explosive charge (explosive) 22 is contained inside the charge case 21 and is arranged between the inner wall of the charge case and a liner 23. A primer column 24 (or other ballistic transfer element) is a sensitive area that provides the detonating link between the main explosive charge 22 and a detonating cord 25, which is attached to an end of the shaped charge. Examples of explosives 22 that may be used in the various explosive components (e.g., charges, detonating cord, and boosters) include RDX (cyclotrimethylenetrinitramine or hexahydro-1,3,5-trinitro-1,3,5-triazine), HMX (cyclotetramethylenetetranitramine or 1,3,5,7-tetranitro-1,3,5,7-tetraazacyclooctane), TATB (triaminotrinitrobenzene), HNS (hexanitrostilbene), and others.

To detonate a shaped charge, a detonation wave traveling through the detonating cord 25 initiates the primer column 24 when the detonation wave passes by, which in turn initiates detonation of the main explosive charge 22 to create a detonation wave that sweeps through the shaped charge. The liner 23 collapses under the detonation force of the main explosive charge.

Figure 3:
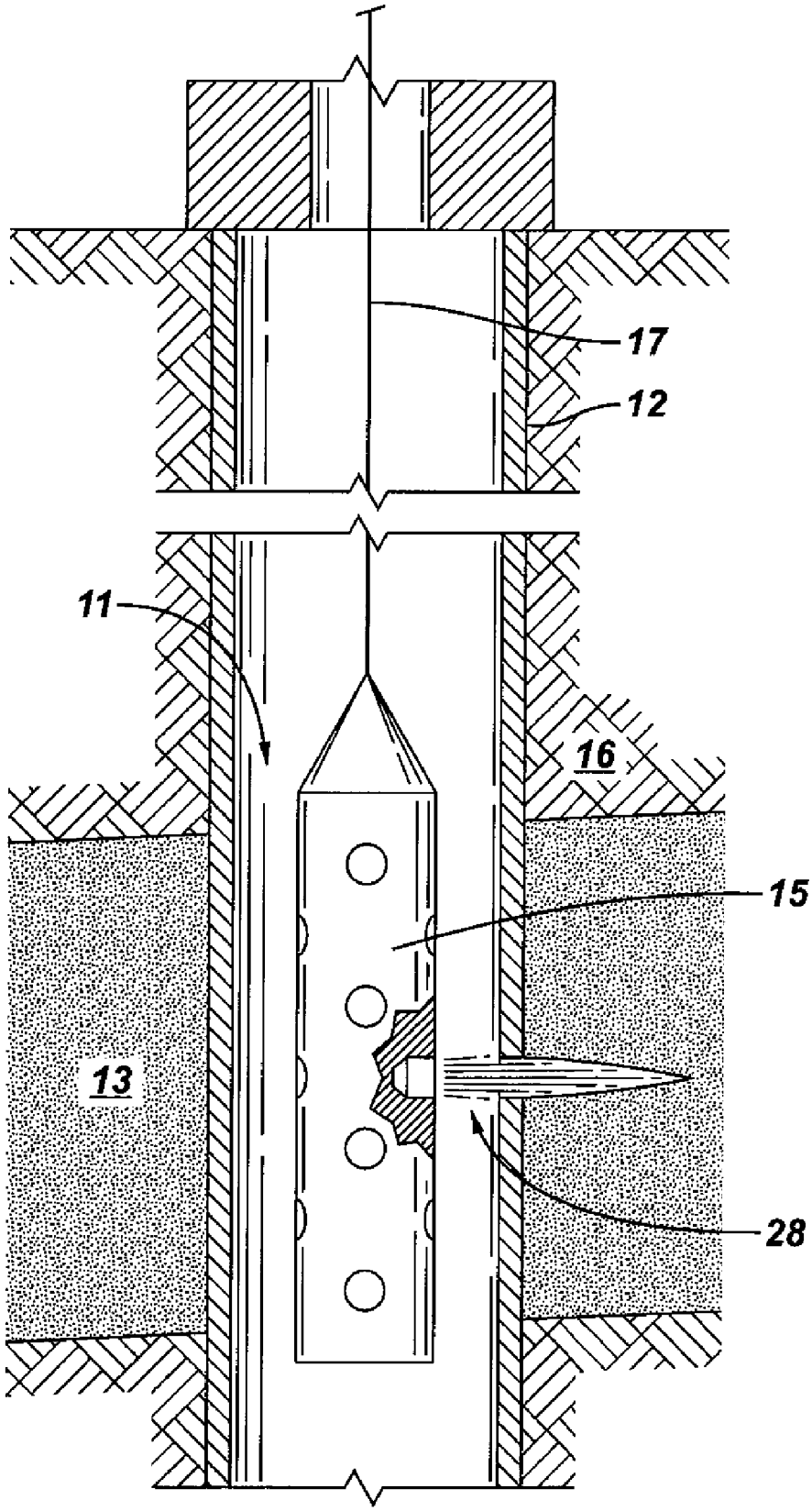
FIG. 3 shows a diagram illustrating a perforation being made with a perforation gun in accordance with embodiments of the present invention.
Figure 4:
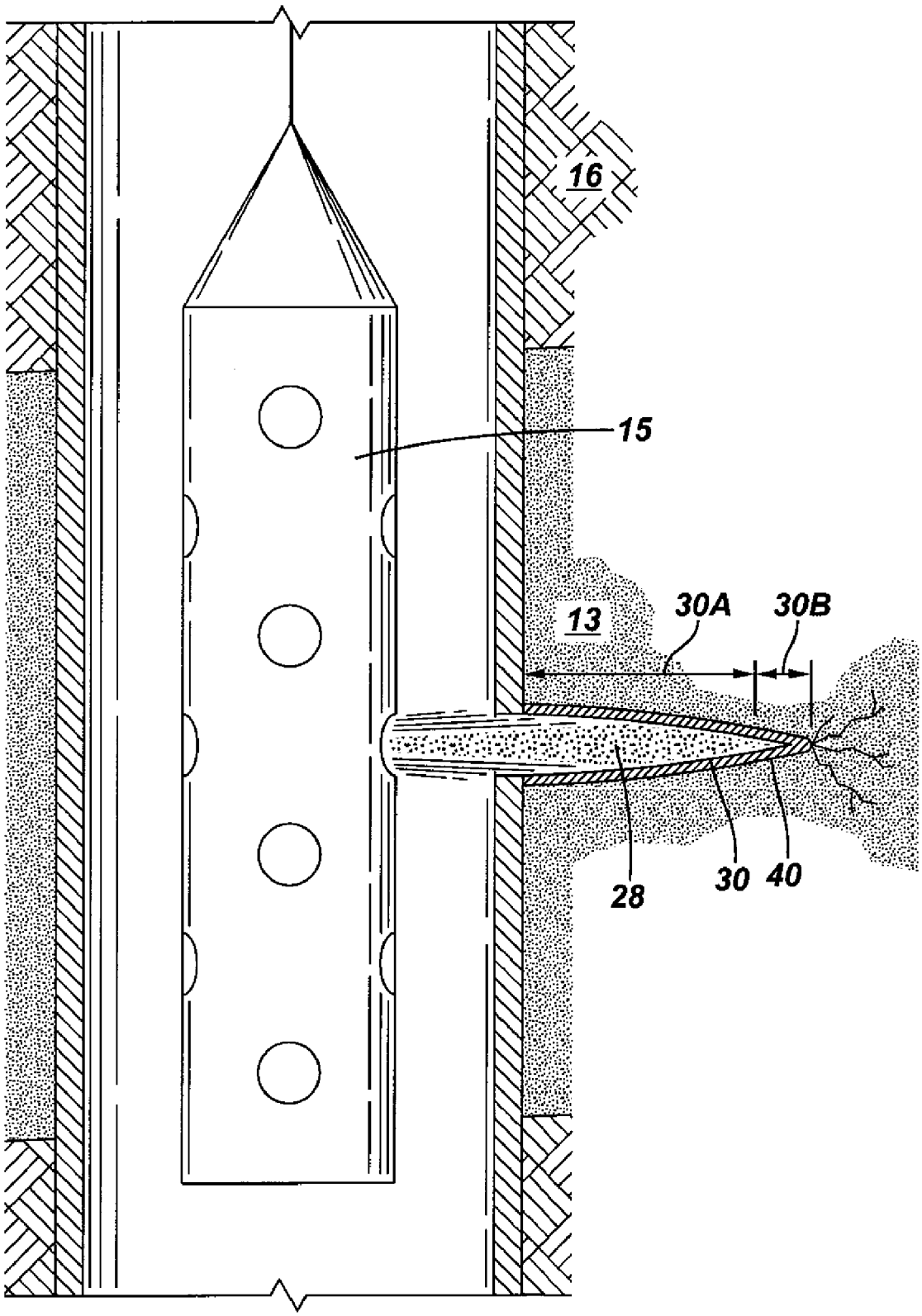
FIG. 4 shows a diagram illustrating a perforation and a tunnel made with a shaped charge in accordance with embodiments of the present invention, wherein the tunnel has charge liner residue remaining on the wall and tip of the tunnel.

Referring to FIGS. 3 and 4, the material from the collapsed liner 23 forms a perforating jet 28 that shoots through the front of the shaped charge and penetrates the casing 12 and underlying formation 16 to form a perforated tunnel (or perforation tunnel) 40. Around the surface region adjacent to the perforated tunnel 40, a layer of residue 30 from the charge liner 23 is deposited. The charge liner residue 30 includes "wall" residue 30A deposited on the wall of the perforating tunnel 40 and "tip" residue 30B deposited at the tip of the perforating tunnel 40.

Figure 5:
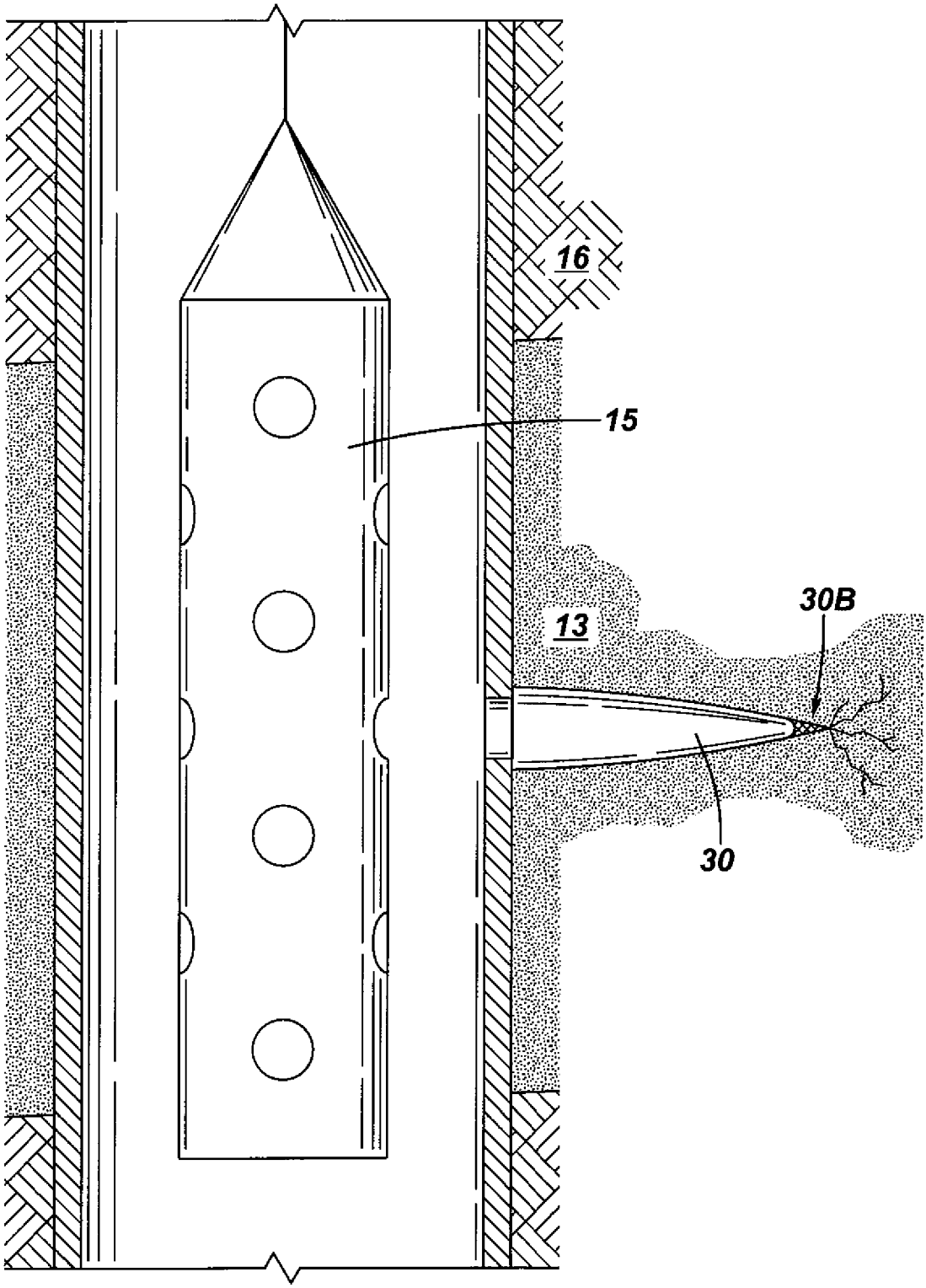
FIG. 5 shows a diagram illustrating the removal of the charge liner residue from the wall of the tunnel and the remaining charge liner residue in the tip of the tunnel in accordance with embodiments of the present invention.
Figure 5A:
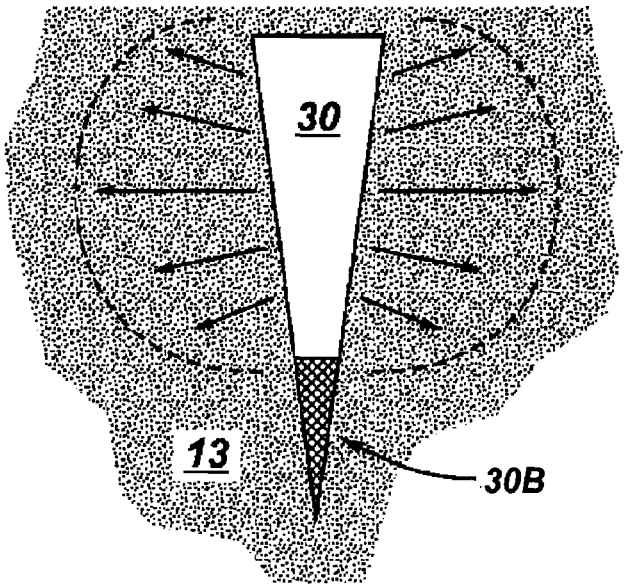
FIG. 5A illustrates an injection flow field in a perforating tunnel having the tip region blocked.
Figure 5B:
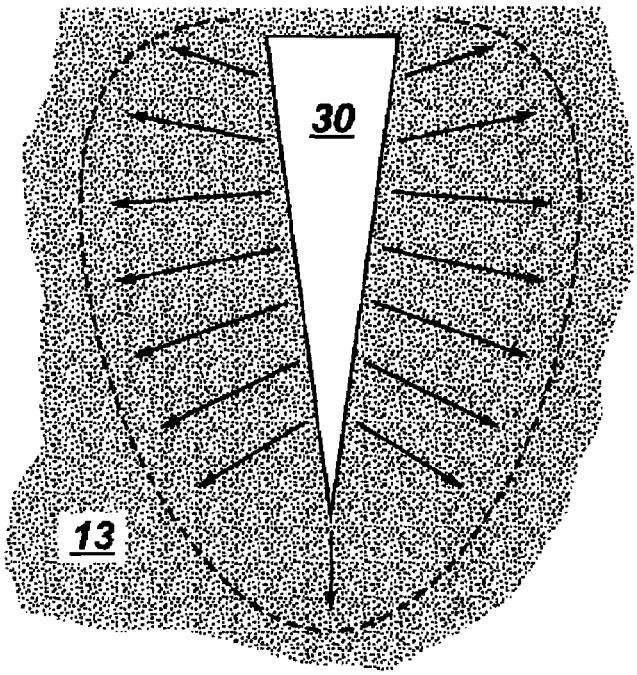
FIG. 5B illustrates an injection flow field in a clean perforating tunnel.

Charge liner residue is typically not considered detrimental to productivity as reservoir fluids may flow around or even through the residue and into the perforating tunnel (although there is no doubt that a cleaner tunnel will generate improved productivity, so removal of the charge liner residue should yield at least somewhat improved productivity). However, charge liner residue in the perforating tunnel is generally considered detrimental to injectivity. For example, with reference to FIGS. 4 and 5, injection pressures can compact the charge liner residue 30 (and other tunnel debris) against the tip region 30B of the tunnel 40, rendering it impermeable, therefore reducing the tunnel surface exposed to fluid infiltration. One consequence of this is increased injection pressure for a given flow rate. A second consequence is an alteration of the flow field of the infiltrating fluid as shown in FIG. 5A. An unaltered (i.e., preferred) flow field is shown in FIG. 5B. These mechanisms can result in increased pumping power requirements, and/or less than optimum well performance. The problem posed by tunnel fill can adversely affect any injection operation—such as matrix acidizing, hydraulic fracturing, or long-term injection for enhanced recovery or storage (water, steam, CO2, etc.).

In accordance with embodiments of the present invention, the shaped charge (capsule charge, or other explosive charge) includes a liner fabricated from a material (e.g., a metal) that is soluble in the presence of a dissolving fluid (e.g., an acid, an injection fluid, a fracturing fluid, or a completions fluid). As a result, any liner residue remaining in the perforation tunnel post-detonation (specifically, in the tip region of the tunnel) may be dissolved into the dissolving fluid and will no longer be detrimental to injection operations. It is significant that the material used in the charge liner be targeted to correspond with a dissolving fluid in which the liner material is soluble in presence of.

With reference to FIGS. 1 and 2, other embodiments of the present invention include a perforation system comprising: (1) a perforating gun 15 (or gun string), wherein each gun may be a carrier gun (as shown) or a capsule gun (not shown); and (2) one or more improved shaped charges 20 loaded into the perforating gun 15 (or into each gun of the gun string), each charge having a liner 23 fabricated from a material that is soluble in presence of a dissolving fluid (as described in afore-mentioned embodiments); and (3) a conveyance mechanism 17 for deploying the perforating gun 15 (or gun string) into a wellbore 11 to align at least one of said shaped charges 20 within a target formation interval 13, wherein the conveyance mechanism may be a wireline, stick line, tubing, or other conventional perforating deployment structure; and (4) a selected dissolving fluid having properties that correspond with the liner material such that the liner material is soluble in the presence of such fluid (as described in aforementioned embodiments).

In another aspect, embodiments of the invention relate to methods for perforating in a well. FIGS. 6-9 illustrate various methods to achieve improved perforations in a wellbore.

Figure 6:
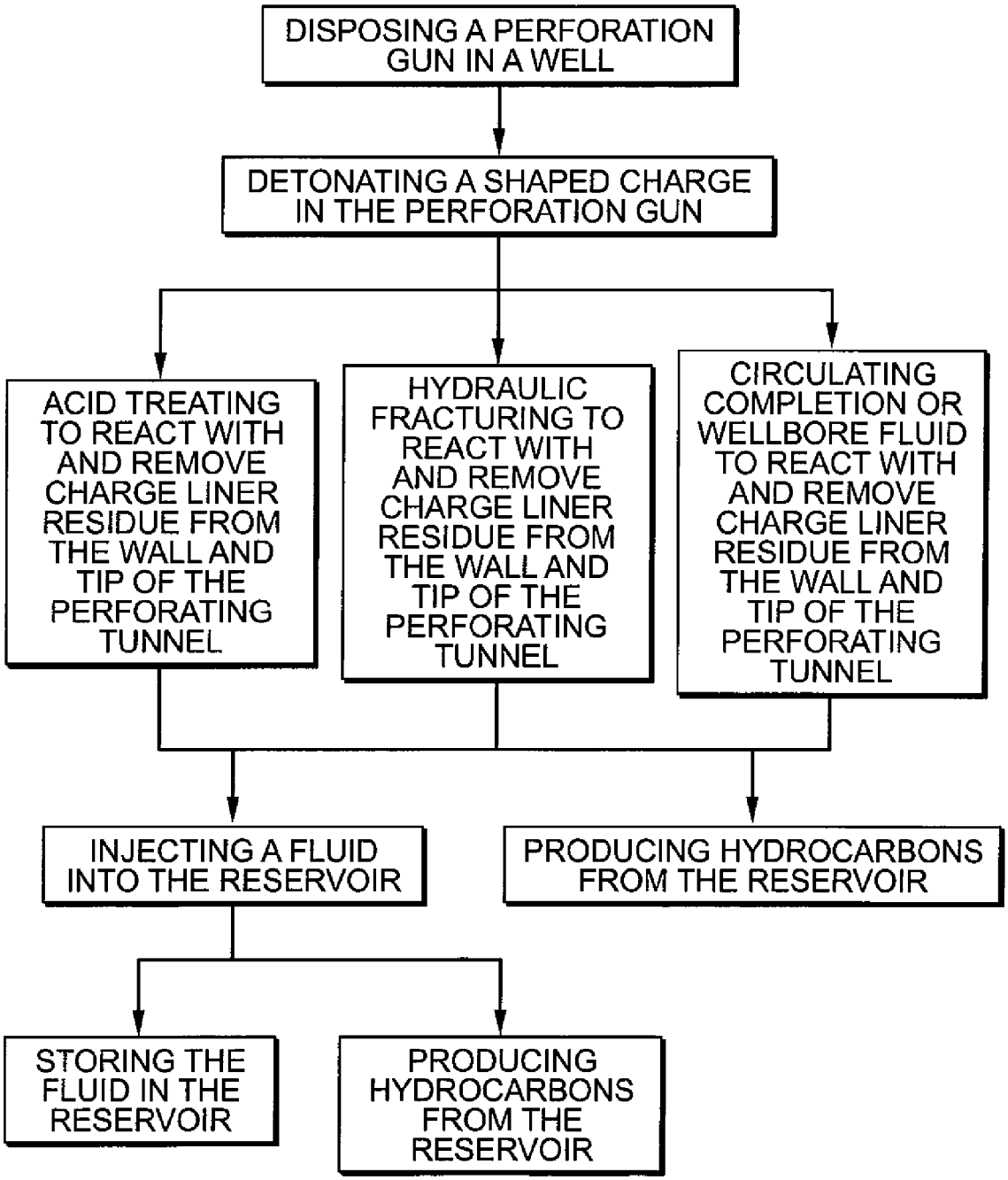
FIGS. 6-9 show methods for perforating a well in accordance with various embodiments of the present invention.

With reference to FIG. 6, methods for perforating in a well include: (1) disposing a perforating gun in the well, wherein the perforating gun comprises a shaped charge having a charge case, an explosive disposed inside the charge case, and a liner for retaining the explosive in the charge case, wherein the liner includes a material that is soluble with an acid, an injection fluid, a fracturing fluid, or a completions fluid; (2) detonating the shaped charge to form a perforation tunnel in a formation zone and leaving charge liner residue within the perforating tunnel (on the well and tip); (3) performing one of the following: (i) pumping an acid downhole, (ii) pumping a fracturing fluid downhole, (iii) pumping an injection fluid downhole, or (iv) circulating a completion or wellbore fluid downhole to contact the charge liner residue in the perforation tunnel; and (4) allowing the material comprising the liner to dissolve with the acid, an injection fluid, a fracturing fluid, or a completions fluid. After such operation, a treatment fluid may be injected into the formation and/or the formation may be produced. In alternative embodiments, a fluid may be injected in the formation (e.g., produced water) for storage.

Figure 7:
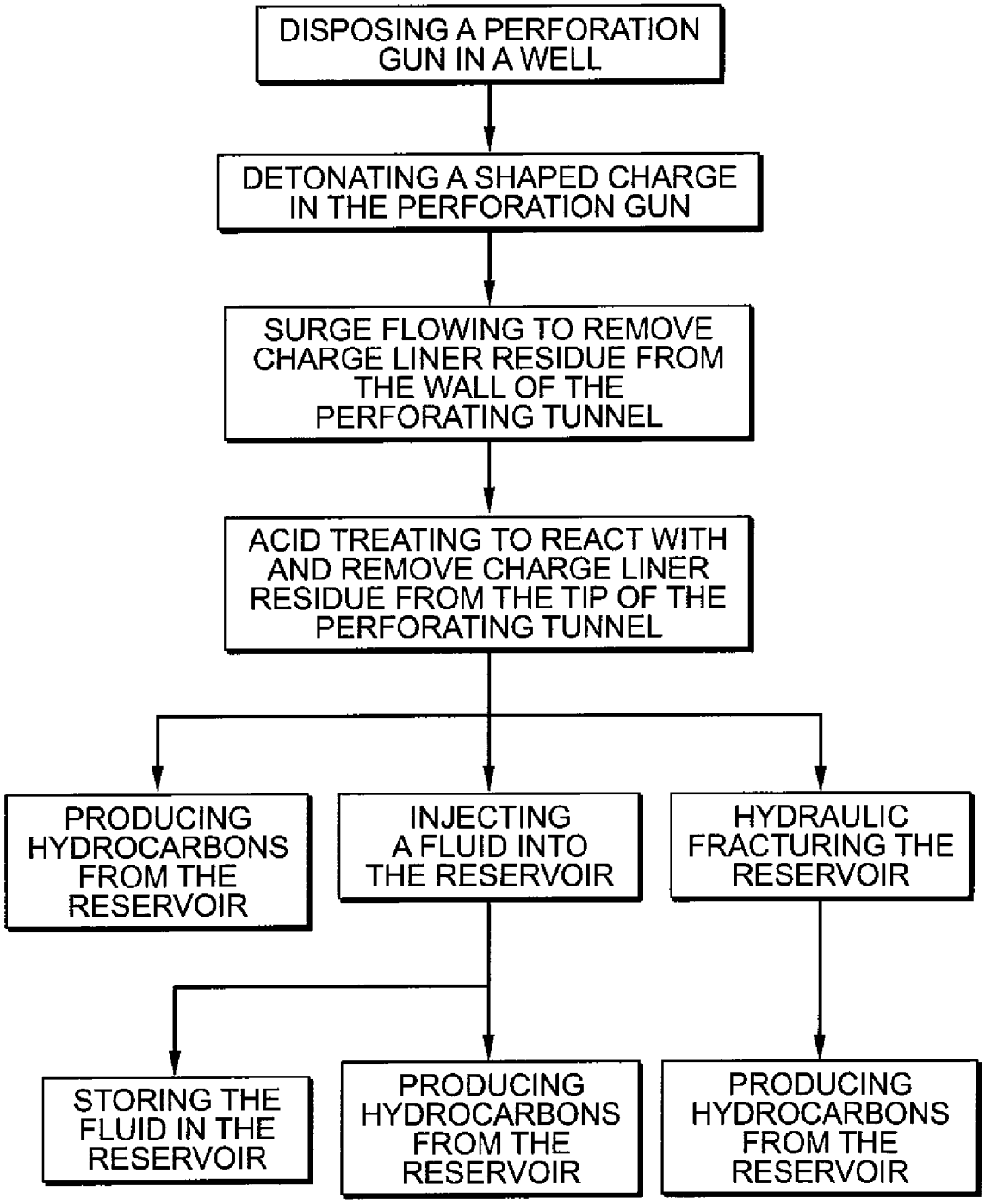
Figure 8:
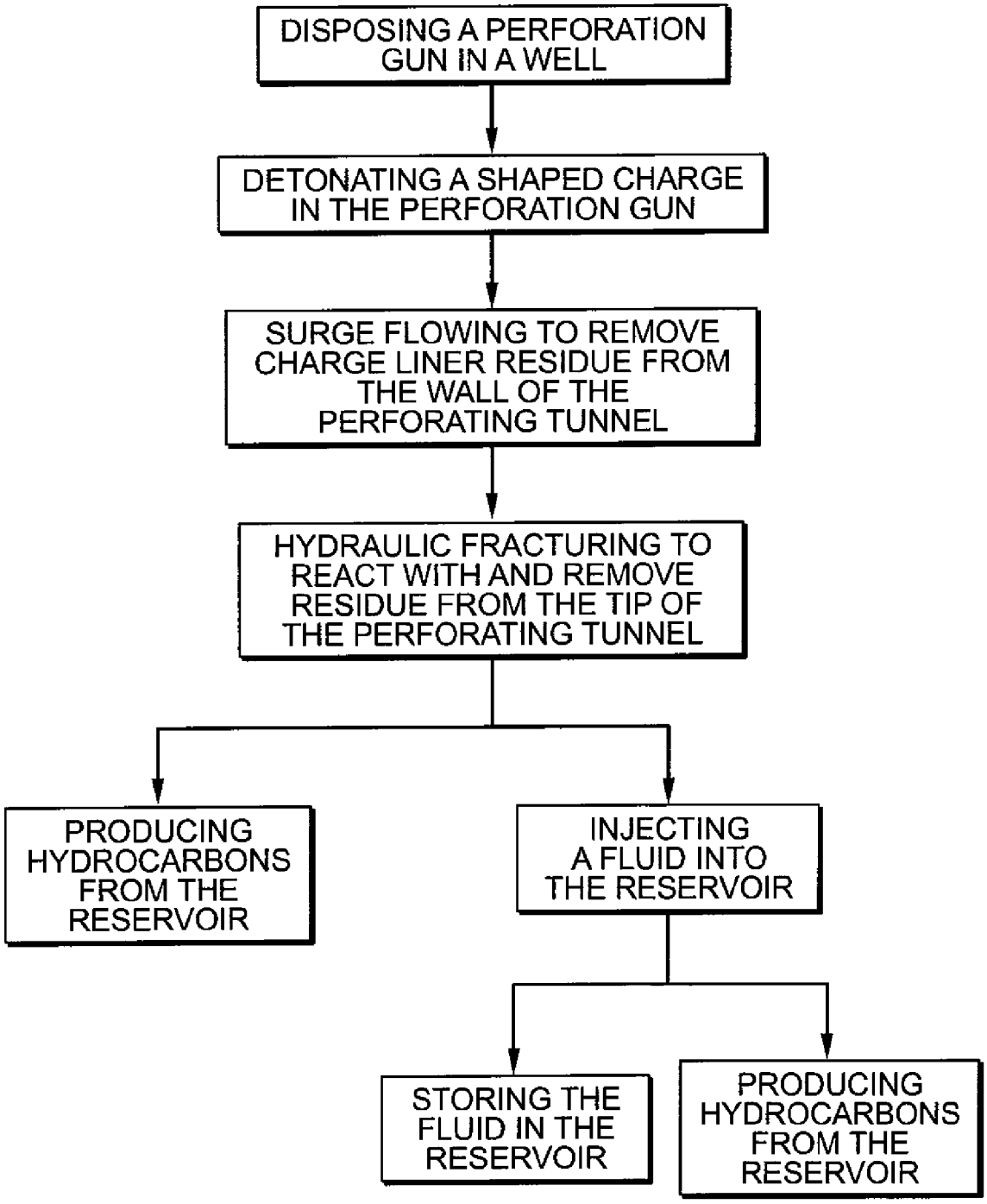
Figure 9:
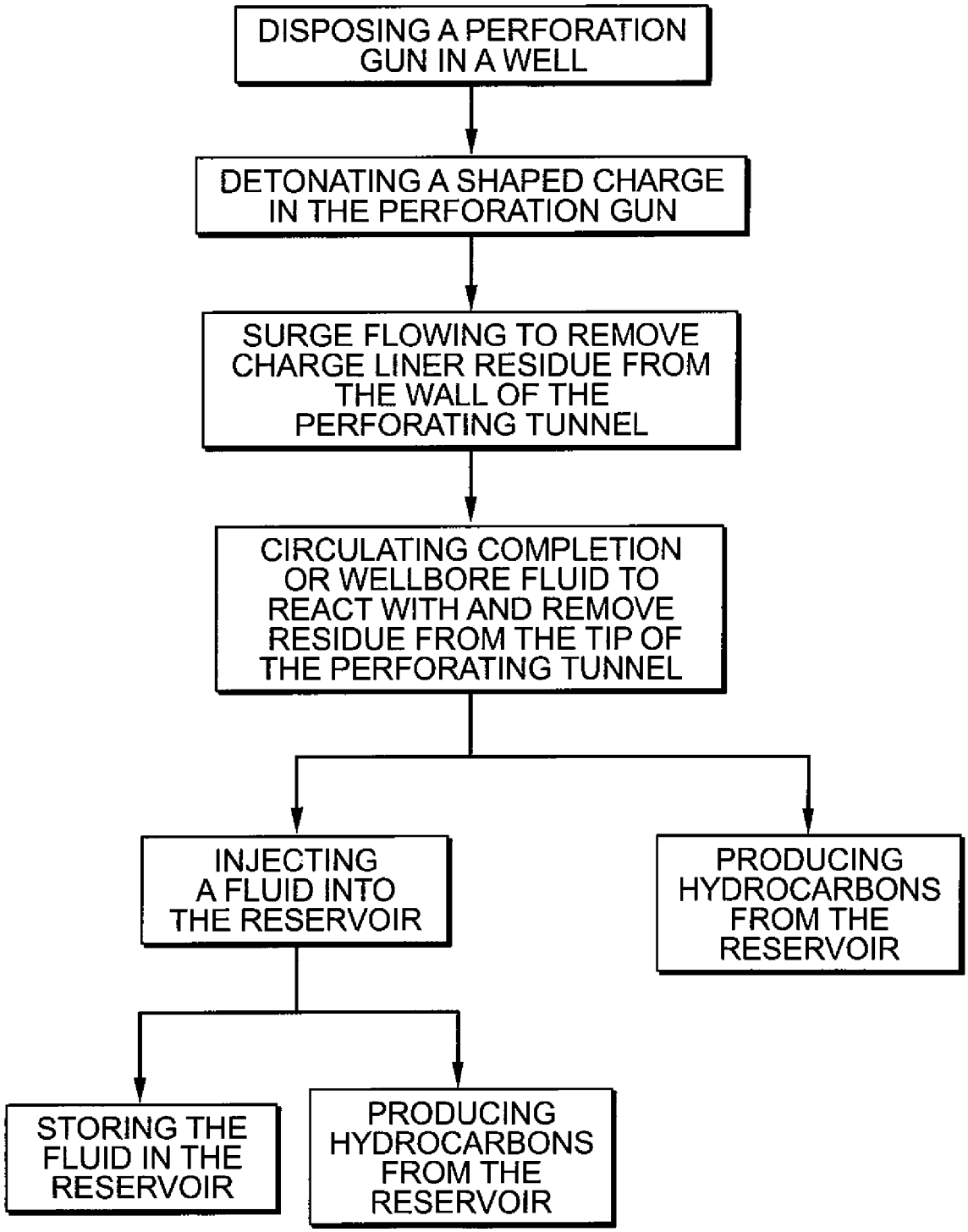

In alternative embodiments, as shown in FIGS. 7-9, before the pumping operation, the perforating tunnel is surged (e.g., by creating a dynamic underbalanced in the well proximate the perforation tunnel) to remove the charge liner residue from the wall of the perforating tunnel. In these embodiments, the pumping operation is directed at removing the charge liner residue from the tip of the perforating tunnel.

While certain embodiments of the present invention are described with respect to perforating a cased wellbore, it is intended that other embodiments may be used for enhanced perforation of open hole or "uncased" wells. Moreover, while some embodiments of the perforating charge described above include an enhanced shaped charge, it is intended that other embodiments include an enhanced capsule charge or any charge for use in perforating a wellbore formation.

Shaped charge liners in accordance with embodiments of the invention may be prepared with any method known in the art, including: 1) casting processes; 2) forming processes, such as powder metallurgy techniques, hot working techniques, and cold working techniques; 3) machining processes; and 4) other techniques, such as grinding and metallizing. Shaped charges of the invention may be manufactured with existing equipment and may be deployed with existing techniques.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for perforating a formation interval in a well, comprising:

disposing a shaped charge in the well proximate the formation interval, wherein the shaped charge comprises a liner formed of a dissolvable material selected from: iron, magnesium, zinc, aluminum, and any alloy or combination thereof;

detonating the shaped charge to form a perforation tunnel in the formation interval and deposit a liner residue in the perforation tunnel;

surging the perforation tunnel after detonating the shaped charge to remove liner residue from a wall region of the perforating tunnel;

selecting a fluid adapted to dissolve the liner residue, the fluid being an acid selected from: hydrochloric acid, hydrofluoric acid, acetic acid, and formic acid; and pumping the fluid into contact with the perforation tunnel to dissolve the liner residue from a tip region of the perforation tunnel after the perforation tunnel has been surged.

2. The method of claim 1, further comprising pumping a second fluid into contact with the perforation tunnel, wherein the second fluid is at least one selected from: an acid, a fracturing fluid, a completion fluid, and water.

3. The method of claim 2, wherein the second fluid is an acid, and the acid is at least one selected from: hydrochloric acid, hydrofluoric acid, acetic acid, and formic acid.

4. The method of claim 2, wherein the second fluid is a fracturing fluid, and the fracturing fluid is at least one selected from: water, hydrochloric acid, hydrofluoric acid, acetic acid, and formic acid.

5. The method of claim 2, wherein the second fluid is water, and the water is seawater.

6. The method of claim 2, wherein the second fluid is a completion fluid, and the completion fluid is brine.

7. The method of claim 1, the fluid being hydrochloric acid.

8. The method of claim 1, the fluid being hydrofluoric acid.

9. The method of claim 1, the fluid being acetic acid.

10. The method of claim 1, the fluid being formic acid.

* * * * *